United States Patent [19]

Wixon

[11] 4,339,335

[45] Jul. 13, 1982

[54] FREE FLOWING HIGH BULK DENSITY PARTICULATE DETERGENT-SOFTENER

[75] Inventor: Harold E. Wixon, New Brunswick, N.J.

[73] Assignee: Colgate Palmolive Co., New York, N.Y.

[21] Appl. No.: 134,558

[22] Filed: Mar. 27, 1980

Related U.S. Application Data

[63] Continuation of Ser. No. 746,994, Dec. 2, 1976, abandoned.

[51] Int. Cl.[3] ..... C11D 1/835; C11D 3/12; C11D 17/06; D06M 13/46

[52] U.S. Cl. ..... 252/8.8; 252/135; 252/140; 252/174; 252/174.13; 252/174.14; 252/179; 252/528

[58] Field of Search ..... 252/8.6, 8.75, 8.8, 252/131, 135, 140, 174.25, 179, 528

[56] References Cited

U.S. PATENT DOCUMENTS

| | | | |
|---|---|---|---|
| 3,290,158 | 12/1966 | Treat | 252/385 |
| 3,360,470 | 12/1967 | Wixon | 252/99 |
| 3,607,763 | 9/1971 | Salmen | 252/528 |
| 3,755,180 | 8/1973 | Austin | 252/99 |
| 3,838,072 | 9/1974 | Smith | 252/540 |
| 3,868,336 | 2/1975 | Mazzola | 252/527 |
| 3,915,878 | 10/1975 | Yurko | 252/89 |
| 3,915,882 | 10/1975 | Nirschl | 252/131 |
| 3,944,500 | 3/1976 | Gancy | 252/182 |
| 4,007,124 | 2/1977 | Collier | 252/109 |

FOREIGN PATENT DOCUMENTS

| | | | |
|---|---|---|---|
| 849234 | 4/1977 | Belgium . | |
| 2538755 | 3/1976 | Fed. Rep. of Germany | 252/8.8 |
| 2655578 | 6/1977 | Fed. Rep. of Germany . | |

*Primary Examiner*—Dennis L. Albrecht

[57] ABSTRACT

A free flowing, particulate detergent-softener of high bulk density is comprised of nucleus particles of builder salt, preferably a mixture of sodium carbonate and sodium bicarbonate, having nonionic detergent in the interior and on the surface thereof, to which is adhered a coating of smaller particles of ion exchanging zeolite, and quaternary ammonium halide fabric softening compound. In a preferred embodiment of the invention the quaternary ammonium halide is "insulated" from immediate contact with laundry when the detergent-softener is added to the wash water by being added to the nucleus particles with the nonionic detergent, after which the resulting particles are coated with the zeolite powder. In another embodiment of the invention the product described is further coated with nonionic detergent and zeolite.

9 Claims, No Drawings

FREE FLOWING HIGH BULK DENSITY PARTICULATE DETERGENT-SOFTENER

This is a continuation, of application Ser. No. 746,994 filed Dec. 2, 1976, now abandoned.

This invention relates to improved free flowing, concentrated, high bulk density, particulate, detergent-fabric softening compositions and to methods for their manufacture.

Compositions which have combination laundry detergent and fabric softening effects are known. Nonionic detergents are known to be useful components of detergent compositions and quaternary ammonium halides having a long chain lipophilic moiety on the nitrogen thereof have been successfully employed as fabric softeners and anti-static agents. Inorganic builder salts such as phosphates, carbonates and silicates have long been utilized as builders for organic detergents, and zeolites, such as sodium aluminosilicates, have recently also been employed for this purpose. Although most particulate detergents are of low bulk density it is known to make high bulk density particulate detergent compositions, too. Nevertheless, before the present invention it was not known to make a high bulk density, particulate detergent-fabric softener of the desired characteristics of the products described herein nor were the methods for the manufacture of such products shown in the prior art or obvious therefrom.

In accordance with the present invention a free flowing particulate detergent-softener of bulk density of at least 0.6 g./cc. and particle sizes in the range of 4 to 40 mesh comprises nucleus particles of an alkali metal builder salt selected from the group consisting of sodium carbonate mixed with sodium bicarbonate, sodium carbonate, sodium bicarbonate, pentasodium tripolyphosphate, tetrasodium pyrophosphate, sodium silicate, borax and mixtures thereof, containing a normally liquid or pasty nonionic detergent in the interiors of such particles and on the surfaces thereof and coated with ion exchanging zeolite particles adhered to the nonionic detergent on the builder particle surfaces, and a waxy quaternary ammonium compound softening agent, which may be external to or included within said particles. This invention also relates to re-coated products and to methods for manufacture of the invented particulate detergent-softeners.

The products of this invention are excellent heavy duty detergent-fabric softeners of suitable high bulk densities to make it possible to utilize small volumes thereof, e.g., 50–150 cc., for an average wash in an automatic washing machine (which has a tub volume of about 30 to 65 liters and washes a charge of about 4 kg. of soiled garments, etc.). Thus, smaller packages may be employed for similar effective quantities of detergent-softener composition and shelf space may be conserved in the supermarket and in the home. Of course, it is also easier to handle the smaller packages and to pour from them, resulting in more convenience and less spillage.

The nucleus particles or bases into and onto which nonionic detergent is added may be any suitable builder salts which are sufficiently sorptive for the nonionic detergent, when it is in the liquid state. Normally it is desirable for the builder particles to be of rounded forms, most preferably spherical, with passageways through the particles to the interiors thereof which allow the sorption of at least 10%, preferably 20% and most preferably 30% or more of nonionic detergent, by weight, into the builder particle. Suitable builders that may be employed include a preferred mixture of sodium carbonate and sodium bicarbonate (including Wegscheider's salt), which will be described in more detail, sodium carbonate, sodium bicarbonate, pentasodium tripolyphosphate, tetrasodium pyrophosphate, sodium silicate ($Na_2O:SiO_2$ ratios in the range of 1:1.6 to 1:3) and borax. Such products, which may be spray dried, agglomerated or made by other suitable process, will preferably have particle sizes like those of the preferred carbonate-bicarbonate mixture, to be described. Of course, mixtures of various builders may be employed, as may be mixtures of the various other components of the invented compositions. In addition to the sodium salts, other alkali metal salts, principally potassium salts, may be utilized but these are not normally preferred.

In place of some of the inorganic builder salt there may be used organic builders, such as sodium citrate, trisodium nitrilotriacetate, CMOS (sodium carboxymethyl oxysuccinate), sodium gluconate and sodium EDTA. However, the total content of such organic builders will usually be only a minor proportion of the total builder content, preferably being less than 25% thereof. Also, some of the builder salt may be replaced by sodium sulfate or other compatible filler, but again this will usually be present in only a minor proportion and preferably will be less than 25% of the total builder plus filler salt content.

The preferred mixture of alkali metal carbonate and alkali metal bicarbonate is very preferably a mixture thereof wherein both types of compounds are present in the same individual beads or particles. For the purpose of this invention such particles should desirably have sizes within the 20 to 100 mesh range, preferably being 30 to 60 mesh and most preferably about 40 mesh (the word "mesh" is used interchangeably with "No."). Larger particles, up to about 8 mesh, may be used providing that the resulting final product size is in the desired range. In some such cases efforts will be made to prevent any agglomeration or appreciable size growth taking place during absorption of nonionic detergent or else the final particle sizes will usually be too large. When sizes smaller than those in the desirable range indicated are used there is sometimes produced an unacceptable pasty product, rather than individual free flowing beads.

The alkali metal (sodium or potassium being preferred) carbonates and bicarbonates, most preferably as the sodium salts, will be essentially anhydrous in preferred embodiments of the invention but partially dehyrated builder salts of this type may be tolerated. Normally, moisture contents will be less than 9%, preferably less than 7%. The proportion of alkali metal carbonate to alkali metal bicarbonate by weight, will generally be within the range of 1:10 to 10:1, preferably being with the range of 1:5 to 1:1, more preferably in that of 1:3 to 1:1 and most preferably about 1:2. The mixed product is preferably made by a method which results in a substantial content, e.g., 10 to 100% of Wegscheider's salt, with any balance being sodium bicarbonate. Such a product is of excellent sorptive powers for liquid nonionic detergent and may be readily converted into a suitable base for a zeolite builder powder coating. A method for the manufacture of a mixed carbonate-bicarbonate product used successfully is shown in U.S. Pat. No. 3,944,500 of Gancy et al., hereby incorporated by reference. A useful mixed carbonate-bicarbonate of the type described is available from Allied Chemical Corporation under the name Snowlite®. Although the method of the patent is a preferable one the mixed carbonate-bicarbonate beads may be made by other techniques. In one aspect of this invention instead of the carbonate and bicarbonate being intimately associated in single beads separate charges of carbonate and bicarbonate may be utilized, preferably of the same sizes and proportions as for the products described above, providing that they are sufficiently sorptive to take up the nonionic detergent in sufficient quantity to produce the desired final products. Also, one may employ more finely divided carbonate and bicarbonate powders, such as those of particle sizes below 100 mesh, e.g., 170 to 270 mesh, and agglomerate these, either separately or in mixture, with care being taken to preserve the porosity of the product by employing only minimum amounts of a binder, such as starch or other agglomerating agent. Wegscheider's salt may also be added to such products.

The softening compounds which may be employed to soften laundry and help to make it wrinkle resistant and static-free include a wide variety of compounds which have substantial portions of the molecules thereof positively charged. Generally, such compounds will include hydrophobic groups as parts of the positively charged portions and often such groups will be relatively long chain radicals, such as higher hydrocarbyls or alkyls. Although amines, imidazolines, pyridines, guanidines and salts and derivatives thereof are useful, especially if they contain relatively long chain hydrophobic groups, the most preferred softening agents will usually be quaternary ammonium compounds containing one or two long chain hydrophobic groups and two or three short chain groups, with a solubilizing cation or a salt-forming group, usually either halide, sulfate, acetate, hydroxide, or other inorganic or organic solubilizing mono- or dibasic radical. Various cationic compounds that are useful in the present invention are also described in U.S. Pat. Nos. 3,227,614 and 3,442,692.

In the quaternary ammonium compounds and salts the longer chain substituents of the nitrogen are preferably higher alkyl groups of 12 to 18 carbon atoms, more preferably of 16 to 18 carbon atoms and most preferably stearyl, and the shorter hydrophobic radicals are alkyls of 1 to 4 carbon atoms, preferably of 1 to 2 carbon atoms and most preferably methyl. Similar long chain substituents are present on the imidazolines and imidazoles, the pyridines and piperidines, the guanidines and the amines. Specific examples of preferred cationic conditioning agents employed in accordance with the present invention include dimethyl distearyl ammonium chloride; trimethyl stearyl ammonium bromide; cetyl trimethyl ammonium chloride; di-higher alkyl dimethyl ammonium chloride wherein the higher alkyl is obtained from hydrogenated tallow alcohols; cetyl pyridinium chloride; higher alkyl dimethyl benzyl ammonium chloride; di-isobutyl phenoxy ethoxy ethyl dimethyl benzyl ammonium chloride; and lauryl isoquinolinium bromide. Although these are preferred compounds, the higher alkyl amines and other cationic conditioning agents which are known to be useful for softening various fabrics and fibers and making them wrinkle resistant or static-free may also be employed, instead. Such compounds will be strongly substantive to fabrics, especially those of cotton or cellulosic materials and synthetic organic fibers. Also, the described softening compounds, including higher alkyl groups, usually are waxy or pasty solids and may be melted or fused at elevated temperatures, so as to be useful to coat base particles of this invention. Such coating may be effected by mixing comparatively soft particles of softener compound with material to which such are to be adhered, such as carbonate-bicarbonate-nonionic detergent-zeolite particles or the softener may be melted and sprayed onto nucleus particles or may be mixed with nonionic and co-sprayed onto such particles. In the present products, due largely to the use of nonionic detergent instead of anionic detergent, with which cationic softeners often react, the softener compound maintains its effectiveness in use.

The nonionic detergents include those described at length in McCutcheon's *Detergents and Emulsifiers*, 1973 Annual and in *Surface Active Agents*, Vol. II, by Schwartz, Perry and Berch (Interscience Publishers, 1958), the descriptions of which are hereby incorporated by reference. Such nonionic detergents are usually pasty or waxy solids at room temperature (20° C.) which are either sufficiently water soluble to dissolve promptly in water or will quickly melt at the temperature of the wash water, as when that temperature is above 40° C. The nonionic detergents employed will normally be those which are liquid or pasty at room temperature but preference will be given to normally pasty or semi-solid products because such are less liable to make a tacky product of poor flow properties and susceptibility toward lumping or setting on storage. Also they are less liable to weep and release their "holds" on the zeolites. Still, normally liquid nonionic detergents may be employed and nonionic detergents used will be liquefiable so that they may be sprayed at reasonable temperatures, such as those below 45°, 50° or 60° C. Typical useful nonionic detergents are the poly-(lower alkenoxy) derivatives that are usually prepared by the condensation of lower (2 to 4 carbon atoms) alkylene oxide, e.g., ethylene oxide, propylene oxide (with enough ethylene oxide to make a water soluble product), with a compound having a hydrophobic hydrocarbon chain and containing one or more active hydrogen atoms, such as higher alkyl phenols, higher fatty acids, higher fatty mercaptans, higher fatty amines and higher fatty polyols and alcohols, e.g., fatty alcohols having 8 to 20 or 10 or 18 carbon atoms in an alkyl chain and alkoxylated with an average of about 3 to 30, preferably 3 to 15 or 6 to 12 lower alkylene oxide units. Preferred nonionic surfactants are those represented by the formula $RO(C_2H_4O)_nH$, wherein R is the residue of a linear saturated primary alcohol (an alkyl) of 10 to 12 to 18 carbon atoms and n is an integer from 3 or 6 to 15. Typical commercial nonionic surface active agents suitable for use in the invention include Neodol® 45-11, which is an ethoxylation product (having an average of about 11 ethylene oxide units) of a 14 to 15 carbon atoms (average) chain fatty alcohol (made by Shell Chemical Company); Neodol 25-7, a 12 to 15 carbon atom chain fatty alcohol ethoxylated with an average of 7 ethylene oxide units; and Alfonic® 1618-65, which is a 16 to 18 carbon alkanol ethoxylated with an average of 10 to 11 ethylene oxide units (Continental Oil Company). Also useful are the Igepals® of GAF Co., Inc. Such materials are usually the polyethoxylated (3 to 30 ethylene oxide units) middle alkyl (6 to 10 carbon atoms) phenols, such as Igepals CA-630, CA-730 and CO-630. The Pluronics® (made by BASF-Wyandotte), such as Pluronic F-68 and F-127, which are condensates of ethylene oxide with hydrophobic bases formed by condensing propylene oxide with propylene glycol, usually having molecular weights in the range of 5,000 to 25,000, may also be employed, as may be the various Tweens® (products of ICI America), which are polyoxyethylene sorbitan higher fatty acid (12 to 18 carbon atoms) esters, such as those containing solubilizing quantities of ethylene oxide therein. Various other nonionic detergents described in the texts previously incorporated by reference may also be employed but preferably the proportion of nonionic detergent or surface active agent present, when other than the higher fatty alcohol polyoxyethylene ethanols, will be a minor one, rarely being more than 50% and preferably no more than 25 % of the total nonionic detergent content. In the above description higher, as in higher alkyl, higher fatty, etc., means from 8 to 20, preferably from 10 or 12 to 18.

The zeolites which may be employed in practicing the present invention include the crystalline, amorphous and mixed crystalline-amorphous zeolites of both natural and synthetic origins which are of satisfactorily quick and sufficiently effective activities in counteracting hardness ions, such as calcium ions, in wash waters. Preferably, such materials are capable of reacting sufficiently rapidly with hardness cations, such as calcium, magnesium, iron and the like or any one of them, to soften wash water before adverse reactions of such hardness ions with other components of the synthetic organic detergent composition occur. The zeolites employed may be characterized as having a high exchange capacity for calcium ion, which is normally from about 200 to 400 or more milligram equivalents of calcium carbonate hardness per gram of the aluminosilicate, preferably 250 to 350 mg. eq./g. and a hardness depletion rate residual hardness of 0.02 to 0.05 mg. $CaCO_3$/-liter in one minute, preferably 0.02 to 0.03 mg./l., and less than 0.01 mg./l. in 10 minutes, all on an anhydrous zeolite basis.

Although other ion exchanging zeolites may also be utilized normally the finely divided synthetic zeolite builder particles employed in the practice of this invention will be of the formula $$(Na_2O)_x \cdot (Al_2O_3)_y \cdot (SiO_2)_z \cdot w\ H_2O$$

wherein x is 1, y is from 0.8 to 1.2, preferably about 1, z is from 1.5 to 3.5, preferably 2 to 3 or about 2 and w is from 0 to 9, preferably 2.5 to 6.

The water soluble crystalline aluminosilicates used are often characterized by having a network of substantially uniformly sized pores in the range of about 3 to 10 Angstroms, often being about 4 Å (normal), such size being uniquely determined by the unit structure of the zeolite crystal. Of course, zeolites containing two or more such networks of different pore sizes can also be satisfactorily employed, as can mixtures of such crystalline materials with each other and with amorphous materials, etc.

The zeolite should be a univalent cation-exchanging zeolite, i.e., it should be an aluminosilicate of a univalent cation such as sodium, potassium, lithium (when practicable) or other alkali metal, ammonium or hydrogen. Preferably the univalent cation of the zeolite molecular sieve is an alkali metal cation, especially sodium or potassium and most preferably, is sodium, but various other types are also useful.

Crystalline types of zeolites utilizable as good ion exchangers in the invention, at least in part, include zeolites of the following crystal structure groups: A, X, Y, L, mordenite and erionite, of which types A, X and Y are preferred. Mixtures of such molecular sieve zeolites can also be useful, especially when type A zeolite is present. These crystalline types of zeolites are well known in the art and are more particularly described in the text *Zeolite Molecular Sieves* by Donald W. Breck, published in 1974 by John Wiley & Sons. Typical commercially available zeolites of the aforementioned structural types are listed in Table 9.6 at pages 747–749 of the Breck text, which table is incorporated herein by reference.

Preferably the zeolite used in the invention is synthetic and it is also preferable that it be of type A or similar structure, particularly described at page 133 of the aforementioned text. Good results have been obtained when a Type 4A molecular sieve zeolite is employed, wherein the univalent cation of the zeolite is sodium and the pore size of the zeolite is about 4 Angstroms. Such zeolite molecular sieves are described in U.S. Pat. No. 2,882,243, which refers to them as Zeolite A.

Molecular sieve zeolites can be prepared in either a dehydrated or calcined form which contains from about 0 or about 1.5% to about 3% of moisture or in a hydrated or water loaded form which contains additional bound water in an amount from about 4% up to about 36% of the zeolite total weight, depending on the type of zeolite used. The water-containing hydrated form of the molecular sieve zeolite (preferably about 15 to 70% hydrated) is preferred in the practice of this invention when such crystalline product is used. The manufacture of such crystals is well known in the art. For example, in the preparation of Zeolite A, referred to above, the hydrated zeolite crystals that are formed in the crystallization medium (such as a hydrous amorphous sodium aluminosilicate gel) are used without the high temperature dehydration (calcining to 3% or less water content) that is normally practiced in preparing such crystals for use as catalysts, e.g., cracking catalysts. The crystalline zeolite, in either completely hydrated or partially hydrated form, can be recovered by filtering off the crystals from the crystallization medium and drying them in air at ambient temperature so that their water contents are in the range of about 5 to 30% moisture, preferably about 10 to 25%, such as 17 to 22%. However, the moisture content of the molecular sieve zeolite being employed may be much lower, as was previously described.

The zeolites used in this invention should usually also be substantially free of adsorbed gases, such as carbon dioxide, since such gas-containing zeolites can produce undesirable foaming when the zeolite-containing detergent is contacted with water; however, sometimes the foaming is tolerated and it may sometimes be desirable.

Preferably the zeolite should be in a finely divided state with the ultimate particle diameters being up to 20 microns, e.g., 0.005 or 0.01 to 20 microns, preferably being from 0.01 to 15 microns and especially preferably of 0.01 to 8 microns mean particle size, e.g., 3 to 7 or 12 microns, if crystalline, and 0.01 to 0.1 microns, e.g., 0.01 to 0.05 micron, if amorphous. Although the ultimate particle sizes are much lower, usually the zeolite particles will be of sizes within the range of 100 to 400 mesh, preferably 140 to 325 mesh. Zeolites of smaller sizes will often become objectionably dusty and those of larger sizes may not sufficiently and satisfactorily cover the carbonate-bicarbonate base particles.

Although the crystalline synthetic zeolites are more common and better known, amorphous zeolites may be employed instead and are often superior to the crystalline materials in various important properties, as will be described, as may be mixed crystalline-amorphous materials and mixtures of the various types of zeolites described. The particle sizes and pore sizes of such materials may be like those previously described but variations from the indicated ranges may be made, as described, providing that the materials function satisfactorily as builders and do not objectionably overwhiten dyed materials with which they are treated in aqueous media.

Various suitable crystalline molecular sieve zeolites are described in U.S. patent applications of Bao-Ding Cheng, Ser. Nos. 467,688, filed May 7, 1974; 503,734, filed Sept. 6, 1974; and 640,793 and 640,794, filed Dec. 15, 1975, all of which are hereby incorporated by reference for such descriptions and for descriptions therein of other materials within this invention. Other useful such molecular sieve zeolites are illustrated in German Offenlengungsschriften Nos. 2,412,837 and 2,412,839 and in Austrian patent applications A 3277; A 5458; A 5757; A 7160; A 8237; A 9450; A 9449; all of which are also incorporated herein by reference.

A preferred ion exchange zeolite is the amorphous zeolite of Belgian patent No. 835,351 of the formula $$M_2O.Al_2O_3.(SiO_2)_z.w\ H_2O$$

wherein z is from 2.0 to 3.8 and w is from 2.5 to 6, especially when M is sodium. Such patent and applications are also incorporated herein by reference to avoid the necessity for lengthy recitations of such materials, methods for their manufacture and uses, etc.

Various adjuvants, both functional and aesthetic, may be included in the present compositions, such as bleaches, e.g., sodium perborate; colorants, e.g., pigments, dyes; fluorescent brighteners, e.g., stilbene brighteners; foam stabilizers, e.g., alkanolamides, such as lauric myristic diethanolamide; enzymes, e.g., proteases; skin protecting and conditioning agents, such as water soluble proteins of low molecular weight, obtained by hydrolysis of proteinaceous materials, such as animal hair, hides, gelatin, collagen; foam destrolyers, e.g., silicones; bactericides, e.g., hexachlorophene; and perfumes. Usually such adjuvants and any supplemental builders will be admixed with the other components at a particular stage in the manufacturing process which is most suitable, which usually depends on the nature of the adjuvant and its physical state. Particularly desirable will be additions which help to stablize the adjuvant or other components of the product and/or which increase the power of the carbonate-bicarbonate mixture to absorb nonionic detergent. Thus, such adjuvants may be sprayed onto the base particles with the nonionic detergent, may be mixed with the zeolite and applied with it to the nonionic detergent-treated base particles or may be added to such zeolite coated particles, either with the softening agent or after addition of the softening agent.

Normally it is preferred that only nonionic detergents be employed (apart from the softening agent which may be considered as having cationic detergent properties) but sometimes nonionic detergents may be supplemented with an anionic organic detergent, an amphoteric organic detergent or a mixture thereof. However, when such materials are used they will normally be present in minor proportions, preferably less than 25% of the total of nonionic detergent and such detergent(s) and more preferably less than 10% thereof and they will be so located in the product and so incorporated therein as to minimize objectionable reactions between the softening agent and such detergent(s). Thus, when a cationic softener is post-added it will be preferable to have any anionic and amphoteric detergent(s) in the base particles, preferably sprayed onto and into them with the nonionic detergent. Similarly, when the cationic softener is sprayed onto the nucleus particles with the nonionic detergent or separate therefrom it will be preferable to include any anionic and amphoteric detergent(s) on the surfaces of the zeolite-coated beads or possibly they may be mixed with the zeolite and applied to the cationic softener- and nonionic-detergent treated particles.

Among the anionic detergents that are useful are the sulfates and sulfonates of lipophilic moieties, especially those containing higher carbon atoms chains, such as those of 8 to 20 or 10 to 18 carbon atoms. Included among such compounds are the linear higher alkylbenzene sulfonates, olefin sulfonates, paraffin sulfonates, fatty acid soaps, higher fatty alcohol sulfates, higher fatty acid monoglyceride sulfates, sulfated condensation products of ethylene oxide (3 to 30 mols per mol) and higher fatty alcohol, higher fatty acid esters of isethionic acid and other known anionic detergents, such as also are mentioned in the texts previously incorporated herein by reference. Most of these products are normally in solid form, usually as the alkali metal, e.g., sodium, salts and may be spray dried with usual builders. The spray dried particles, including such builders, may be employed as nuclei or base particles in the present invention. Agglomeration techniques, size reduction, pilling and other methods may be employed to make such intermediate products of sizes like those of the carbonate-bicarbonate particles. A few examples of suitable anionic detergents include sodium linear tridecyl benzene sulfonate, sodium cocomonoglyceride sulfate, sodium lauryl sulfate and sodium paraffin and olefin sulfonates, each of an average of about 16 carbon atoms. Amphoteric compounds such as the sodium salt of Miranol® $C_2M$ and Deriphat® 151 may also be utilized in the present detergents. Like the anionic detergents, the amphoterics may be spray dried or otherwise co-formed with a builder or may be dispersed in the liquid nonionic detergent or otherwise suitably mixed with other powders during the making of the present products. Although both anionic and amphoteric detergents may be present in the products of this invention it is highly preferable that the sole detersive copmonent, other than the cationic softener, will be a nonionic detergent or a mixture thereof.

Proportions of nucleus particles (preferably carbonate-bicarbonate), nonionic detergent, zeolite and softening agent should be chosen to result in the desired free-flowing detergent-softener particles of satisfactory high bulk density, when made by the method of this invention. Such proportions are 20 to 40% of nucleus or base particles, 10 or 12 to 30% of nonionic detergent, 30 to 60% of zeolite and 4 to 12% of softening agent, with preferred ranges being 23 to 33%, 13 to 23%, 40 to 52% and 5 to 10%, respectively. The bulk density of the product will be at least 0.6 g./cc., preferably being in the range of 0.75 to 0.95 g./cc. and most preferably being in the 0.8 to 0.9 g./cc. range. The particle sizes of the product will usually be in the range of 4 to 40 mesh, preferably being from 4 to 12 mesh and most preferably being about 6 or 8 mesh. The particle sizes of the carbonate-bicarbonate starting material or other base particles, before any treatment, will usually be in the range of about 20 to 100 mesh, preferably 30 to 60 mesh and most preferably about 40 mesh. However, finer carbonate and bicaronate powders and other builders may be employed initially and may be agglomerated up to the mentioned sizes. Generally, the materials within the mesh ranges given will constitute a mixture of different sized particles within such ranges (this is also true for the various other particulate materials described herein).

In the manufacture of the preferred starting carbonate-bicarbonate mix particles the method of U.S. Pat. No. 3,944,500 may be employed and the product thereof, identified by the trade name Snowlite, obtainable from Allied Chemical Corporation, is preferably used. A typical analysis for Snowlite I is 35% $Na_2CO_3$, 58.5% $NaHCO_3$ and 6.5% $H_2O$ whereas that for another such product, Snowlite II, is 30.0, 66.5 and 3.5%, respectively. Screen analysis (percentages on No. 10, 40, 60 and 100 screens) are 0.2, 67.6, 96.9, 99.0 and 0.7, 60.7, 90.7 and 97.0, respectively. Bulk densities (g./cc.) are 0.51 and 0.48 respectively (tamped) and 0.42 and 0.38 (untamped). Friability is especially low for Snowlite I (2.5% by Allied Chemical Corp. test Na 17–35) and such product is preferred. Low friability and particle strength are also important for other types of base particles that may be used, to prevent them from powdering excessively and forming pastes, rather than individual coated particles, when nonionic detergent is added to them. In some cases other components of the final produce may be included in the mix of bicarbonate and Wegscheider's salt (sesquicarbonate may also be present) being processed by the patent method, providing that they are stable and do not adversely react or interfere with the making of the carbonate-bicarbonate product. Normally the carbonate-bicarbonate particles will contain at least 60%, preferably 70% and more preferably from 70 to 85% or more of carbonate and bicarbonate, when such other adjuvants are present, such as 10 to 20% of sodium silicate and/or 0.1 to 5% of fluorescent brightener, sometimes with 5 to 15% of water, too.

The free flowing, particulate, high bulk density detergent softener of this invention may be made by any of a plurality of methods. In one such method the described sodium carbonate-sodium bicarbonate or other builder particles are admixed with nonionic detergent in liquid form, which detergent is preferably applied by spraying but may be added as a stream too, in some cases. The detergent penetrates the carbonate-bicarbonate particles but also coats the surfaces of such particles so that the subsequently applied zeolite adheres to them. It is important to apply enough nonionic detergent so that in addition to that which is absorbed into the interiors of the builder particles some will be left on the particle surfaces. During the mixing after addition of nonionic detergent the particles resemble wet sand and have a greasy or waxy appearance. The nonionic detergent is normally liquid, pasty or semi-solid and is preferably pasty or semi-solid to minimize any tendency of the product to become tacky or lumpy on storage, although normally liquid nonionics may also be satisfactorily employed. After coating of the base particles with nonionic the zeolite powder is admixed therewith and is adhered to the nonionic detergent on the particle surfaces. The particles made are substantially spherical and are of sizes in the 4 to 40 mesh range. Finally, in this embodiment of the manufacturing method, the softening agent, usually in the form of fairly small granules, flakes, beads or powders, is blended with the base-nonionic-zeolite beads. The softener will normally be a waxy or greasy low melting solid material of particle sizes in the range of of 80 to 160 mesh, preferably being about 100 mesh. It will be held physically and/or electrostatically to the surfaces of the zeolite-coated particles. Of course, the proportions of materials utilized, the mixing times, the temperatures and mixing techniques employed will be such that the product made will be of the desired, previously described composition and properties.

The initial spraying or other mixing of nonionic detergent with the carbonate-bicarbonate or other builder particles is normally effected with the particles at about room temperature (20° to 25° C.) but the temperature may vary over the ranges of 10° to 40° or 50° C. The spraying and admixing may take as little as 1 to 5 minutes and mixing may be continued after completion of the spraying for a period of 0 to 10 minutes, preferably 1 to 5 minutes. The higher fatty alcoholpolyethylene oxide condensation product being sprayed onto the surfaces of the moving beads is usually liquid or is heated to an elevated temperature so that it is liquid and is sprayed onto the moving surfaces or otherwise applied to them so as to distribute it over them and promote absorption of the liquid into the porous particles. Additionally, some agglomeration may be effected during the initial mixing, apparently being due to adhesion or cohesion between some of the finer particles present which have "excessive" amounts of liquid nonionic detergent at the surfaces thereof. During such agglomeration such particles may be increased in size to sizes approximately in the range of the final product, although the subsequent adhesion of zeolite particles does further increase the particle sizes somewhat. Preferably the mixing and spraying of the nonionic detergent onto the moving particles are effected in a rotating drum or tube inclined at a slight angle, such as 5° to 15°. The rotational speed may be any that is suitable, such as 5 to 50 r.p.m. The spraying of the nonionic detergent will normally be such as to produce fine droplets of such detergent, such as those of diameters in the 40 to 200 micron diameter range, preferably 50 to 100 microns but other suitable spray droplet sizes may also be produced and in some cases the nonionic may be blended with the builder particles after being dropped or poured onto the moving surfaces thereof. In such cases one may employ a higher speed or higher energy mixer such as a Lodige mixer, operating at comparatively low speed, or a twin shell or similar type mixer, to prevent excessive agglomeration of particles caused by addition of the larger droplets or streams of nonionic detergent. As was previously indicated, although it is not preferred, sorptive carbonate-bicarbonate particles could be made by methods other than those herein described, wherein more angular products result, but it is highly desirable for the particles to be flowable and most preferably they are somewhat rounded.

After completion of the absorption of the nonionic the zeolite powder is admixed with the product, usually over a period of 1 to 10 minutes, preferably about 5 minutes and is held thereto, forming free flowing beads of particle sizes in the 4 to 40 mesh range. At this stage the product will usually have a moisture content of 2 to 20%, preferably 5 to 15%, including water of hydration. The softening agent, in the form and of the particle sizes previously mentioned, is then "dusted" onto the surfaces of the particles and over a period of 1 to 10 minutes, preferably about 5 minutes, it becomes adhered to them. Due to the relatively small proportion of cationic softener utilized particle sizes are not increased much and the softener particles are sufficiently firmly held to the builder-nonionic-zeolite particles to make a stable, non-segregating and non-dusty finished product. As was previously mentioned, various adjuvants can be incorporated in the product by inclusion with suitable components or may be added thereto in suitable processing steps during the production of the free flowing beads or after such production is essentially complete. The total adjuvant content, excluding water, will rarely exceed 20% of the product and will normally be less than 10%. Of course, if a perborate bleach is utilized the percentage thereof may be increased to an effective bleaching amount, which can be as high as 30% of the product, normally with the proportions of the other important components being proportionately diminished accordingly. The perborate may be co-mixed with the carbonate-bicarbonate mixture or may be post-added to the nonionic-treated mix or to the final product. Colorants, perfumes and other adjuvants may be admixed with the various components and mixtures during manufacture or after completion thereof, too.

In modifications of the manufacturing method, which produce compositions of the same formulas but with further improved properties, the cationic softener is melted and is applied with the nonionic detergent at an elevated temperature at which they are both liquid. Alternatively, the softener and nonionic detergent are applied sequentially to the base particles. In such cases the particles will usually be maintained at a high enough temperature so that the liquids do not prematurely solidify, which could prevent further sorption of such materials. When liquid quaternary softener is applied first, before the nonionic, it tends to penetrate to the interiors of the base particles so that when the nonionic is added, although some of it will penetrate to the particle interiors, a greater proportion thereof than that of the softening agent will be on the surfaces of the materials, where it will adhere to the subsequently applied zeolite powder.

In further modifications of the invented processes portions of the nonionic detergent and zeolite will be held out and will be utilized to re-coat the product. Thus, from about 5 to 50%, preferably about 10 to 30% of the nonionic detergent and zeolite may be post-applied to the product, first the nonionic and then the zeolite, thereby forming an additional protective shell about the product and allowing the inclusion of more nonionic than would otherwise be possible, while still producing a free flowing particulate detergent-softener. Normally as many as six coating operations may be employed but it is preferred that the limit be three (two re-coatings).

The products of this invention have significant advantages over other detergent-softening compositions. They may be made as either phosphate-containing, low phosphate or non-phosphate compositions. The non-phosphate compositions have satisfactory washing properties against a variety of soils normally found on household laundry and yet they comply with legislative and administrative rulings restricting the uses of phosphates in detergents. Therefore, products made may be marketed nationwide and there is no need for a multiplicity of formulations and the restricting of particular shipments of detergent compositions to certain areas of the country. The satisfactory detergency of the product is due to the presence of the nonionic organic detergent and the mixed water soluble inorganic and zeolite builders. While the product is satisfactorily detersive it also includes sufficient softening agent, which is substantive to the laundry, so that the finished laundry is noticeably softer and more static-free than laundry washed with control compositions not containing such softening agent. Normally, one would expect that comparatively high concentrations of nonionic detergents and softening agents, which are themselves usually liquid, pasty, semi-solid or waxy, would cause the product to be "lazy" or poorly flowing, with a tendency to cake on storage, but due to the application of the nonionic to the base particles in liquid form and its penetration to the interiors of such particles, with only a relatively thin coating thereof on their surfaces, which is then coated with zeolite powder (and sometimes some softening agent powder), a very free flowing and non-caking product is obtained. The preferred mixture of carbonate and bicarbonate in the base beads makes a most desirable base for sorption of the nonionic detergent and provides sufficient builder of pH regulating effects so that the product is a satisfactory detergent. However, other base materials may also be employed providing that they are similarly sorptive, e.g., spray dried pentasodium tripolyphosphate, sodium carbonate. When the bicarbonate is present it lowers the normally excessively high pH that would otherwise be obtained by the use of carbonate alone and makes the product safer to use than a carbonate-built detergent. It also significantly improves the power of the composition to sorb nonionic detergent, especially when the bicarbonate is largely in the form of Wegscheider's salt. The zolite powders on the surfaces of the particles, in addition to preventing the nonionic detergent from causing tackiness or poor flow, also protect the product interiors against the action of external moisture and humid conditions. Thus, the compositions may be marketed without the use of special wax coated barrier cartons.

The zeolite, because of its affinity for moisture, takes up such moisture before it can penetrate to the interiors of the particles, where it might have an adverse effect on the bicarbonate or carbonate or where it could, due to the creation of moist alkaline conditions, adversely affect some of the other product constituents, such as the softener or any of various adjuvants. The ion exchanging zeolite, being on the exteriors of the particles and being quickly effective to remove calcium ion from the wash water, acts to remove any possible harmful calcium ion (and other hardness ions) before they can react with any other components of the detergent-softener composition, such as adjuvants, and before they can adversely react with laundry or soil thereon, which reaction could cause the laundry to hold the soil more effectively against the action of the detergent. Also, because zeolites are intimately associated with the nonionic detergent they are maintained better in suspension by the nonionic detergent during the initial period of contact with the wash water, at which time they would normally be of a particle size considerably larger than their ultimate particle size and therefore more likely to be entrapped in the laundry fabrics. Such entrapment would be objectionable because it might cause a lightening of the appearance of dark colored laundry items. The nonionic detergent helps to keep the zeolite particles suspended until they break down to smaller particle sizes which are not as apt to be deposited on the laundry.

The comparatively large particle sizes of the invented products and of the starting materials are somewhat unusual but result in very free flowing particles which still dissolve rapidly and are of high bulk density. Because of the comparatively large particle sizes of the builder salt better absorption of nonionic results, together with desirable coating action, not objectionable paste formation, and the surfaces of the particles contain enough nonionic to hold the desired coating of zeolite powder.

By keeping the softening agent in the interior of the product, as when it is added to the base particles as a liquid before application of zeolite or when it is in a particle which is post-coated, initial contact of the softener with the laundry is prevented, which is desirable because otherwise it might deposit the fabric softening compound on the fabrics and might also cause a reaction of the softener with the soil on the laundry or the fabric of the laundry itself, which would interfere with cleaning thereof. In some cases, when "external" softening agent is added to the laundry and starts to melt it forms greasy spots on the laundry which inhibit cleaning at their locations. The present invention, by having the zeolite and at least some of the nonionic detergent contact the laundry first, helps prevent such undesirable spotting. In a similar manner, when various adjuvants are held in the interiors of the invented particles their initial contact with the laundry is prevented, which is often desirable. Thus, in the case of fluorescent brightening materials, such as those of the stilbene brightener type, first contacts of particles of brightener with the laundry are prevented by inclusion of brightener in the interiors of the particles and thereby excessive bright spots on the laundry are prevented.

The following examples illustrate various embodiments of the invention but the invention is not to be considered as being limited to them. Unless otherwise mentioned, all parts are by weight and all temperatures are in ° C.

EXAMPLE 1

| | Percent |
|---|---|
| Mixed sodium carbonate-sodium bicarbonate building particles (Snowlite I, about 1:2 weight ratio of $Na_2CO_3$ to $NaHCO_3$, of particle sizes in the 20 to 100 mesh range, U.S. Sieve Series) | 27.8 |
| Neodol 25-7 (nonionic detergent condensation product of $C_{12-15}$ higher fatty alcohol with an average of 7 mols ethylene oxide, mfd. by Shell Chemical Company) | 18.5 |
| Type 4A high ion exchange capacity crystalline zeolite (Zeolite CH-252-91-1, of particle sizes in the 170 to 270 mesh range, with ultimate particle sizes in the 3 to 7 micron range, averaging about 5.2 microns, mfd. by J.M. Huber Corp.) | 46.3 |
| Distearyl dimethyl ammonium chloride (Arosurf TA-100, 95% active ingredient powder of particle sizes in the 80 to 160 mesh range, mfd. by Ashland Chemical Company) | 7.4 |

The carbonate-bicarbonate builder beads are charged at room temperature (25° C.) to an inclined drum of 8° inclination, rotating at a speed of about 40 r.p.m. and over a period of five minutes the nonionic detergent, at 30° C. is sprayed onto the moving surfaces of the particles, after which mixing in the drum is continued for another five minutes, after which time the zeolite powder is admixed with the product, also over another five minute period. The nonionic spray is in the form of droplets largely in the range of 50 to 100 microns in diameter and during the spraying and subsequent admixing the particle sizes of the contents of the mixer increase somewhat and any fines present are agglomerated to be within the 20 to 100 mesh range. The zeolite addition is effected over a period of about five minutes (times of 1 to 10 minutes are typical) and at the end of that time the intermediate product particles are spheres in about the 4 to 40 mesh range. Next the powdered fabric softener is mixed with the builder-nonionic-zeolite intermediate product and mixing is continued over a period of eight minutes, during which time the softening agent particles adhere to the large particles. The product resulting is of an untamped bulk density of about 0.8 g./cc. and is free flowing. It is packaged and stored and does not develope objectionable caking or lumps on storage under usual storage conditions for normal storage times. When such a stored package is opened the detergent-softener pours readily and the bulk density is about 0.8 g./cc.

When the product made is subjected to actual washing tests or practical laundry tests it is found that it is non-ducting, free flowing, non-caking and of acceptable detergency and softening properties for commercial applications, comparing favorably to tripolyphosphate-built detergent-softeners of similar active ingredient contents. The zeolite is not objectionably deposited on laundry and does not lighten the colors of dark colored laundry and the carbonate does not have any adverse effects on the cotton, polyester and acrylic materials washed, due to the presence of the bicarbonate, which results in the wash water having a pH of about 9.8. Also, no objectionable greasy spots are produced on the laundry from fusion of softener thereon, apparently because the softener is largely protected from initial gross contact with the laundry by the zeolite on the particle surfaces.

In a comparative experiment finely divided sodium carbonate and sodium bicarbonate powders, of particle sizes in the 170 to 270 mesh range, are used and are agglomerated to a particle size in the 20 to 100 mesh range by preliminary treatment with 5% by weight of a 20% aqueous corn starch paste sprayed onto moving particles of the powdered carbonate and bicarbonate in the same mixing drum previously described, over a period of about three minutes, with the drum moving at slow speed, e.g., 10 r.p.m. The product resulting is a useful detergent-softener at the same concentration used for the previous experiment ($\frac{1}{4}$ to $\frac{1}{2}$ cup or about 45–90 grams per 65 liters tub of wash water), washing charges of about 4 kg. of soiled garments, but is not as free flowing as the previously described detergent-softener. When only sodium bicarbonate is used as a starting builder salt the product does not wash as well as the described preferred product and when carbonate alone is employed the product is more alkaline than desirable and is not as free flowing. However, the carbonate-containing composition does have utility as a detergent-softener in applications wherein higher pH's can be tolerated, although on the retail market it will not be as acceptable as the preferred products of the present invention because of its comparatively poor flow characteristics and higher pH.

In a modification of the above example the Arosurf particles are fusion-agglomerated to sizes within the 4 to 40 mesh range before addition to the balance of the composition. Because of the similar particle sizes no segregation of softener from the previously made rounded beads results but in some cases slight "greasiness" on washed laundry may be observed, although such result is not usually considered serious enough to be objectionable to the average consumer.

In another modification of the example the softening agent is melted with the nonionic detergent and is sprayed onto the base beads so as to be absorbed into the interiors thereof, as well as to have a lesser portion on the surfaces of such beads before they are coated with zeolite particles. The product made is of the same desirable high bulk density and particle sizes as previously described and is an effective detergent-softener in which the softening agent is protected from initial contact with the laundry, whereby undesirable staining is avoided.

Similar results are obtained when the melted quaternary ammonium halide softening agent is sprayed onto the tumbling base particles, followed by spraying on of nonionic detergent and "dusting on" of the zeolite powder. In such last mentioned embodiment stilbene type fluorescent brightener (Tinopal 5BM), mixed with Tinopal RBS (0.5% and 0.05%, respectively) are admixed with the zeolite before it is applied to the nonionic detergent-coated beads. Thus, the fluorescent brightener is effectively prevented from coming into substantial contact with quaternary ammonium compound and any adverse reactions between the two are inhibited. When used to wash laundry the fluorescent brightener and nonionic detergent are both actively working in the wash water before release from the particles of potentially interfering softening agent.

In other modifications of the procedure a quaternary ammonium compound, in liquid form, is sprayed onto the surfaces of the zeolite particles before such particles are coated onto the nonionic-coated carbonate-bicarbonate mixture. The product resulting is comparable in properties to those previously mentioned. This is also the case when the powdered quaternary ammonium compound of the particle size mentioned above is mixed with the zeolite and such mixture is coated onto the waxy, greasy surface of the nonionic coated base particles. In still a different version of the process the powdered quaternary compound is adhered to the nonionic detergent coating of the nucleus particles and zeolite powder is coated over it. A useful detergent-softener of the characteristics previously described is thus obtainable.

EXAMPLE 2

| | Percent |
|---|---|
| Snowlite I | 19 |
| Britesil ® hydrous silicate particles (18% $H_2O$, $Na_2O:SiO_2$ ratio of 1:2, mfd. by Philadelphia Quartz Company) | 9 |
| Neodol 25-7 | 14 |
| Type 4A zeolite (Zeolite CH-252-91-1) | 50 |
| Distearyl dimethyl ammonium chloride (Arosurf TA-100) | 8 |

The Snowlite particles are charged at room temperature to the inclined drum of Example 1, rotating at 12 r.p.m. The hydrous silicate, desirably of approximately the same particle size, is added to the drum, while mixing, over a period of about two minutes and mixing is continued for another three minutes to blend the silicate evenly with the carbonate-bicarbonate particles. Then, over a period of another five minutes the nonionic detergent, at a temperature of about 50° C., mixed with the softening agent, is sprayed onto the moving surfaces of the particles, which are preheated to 40° C. The procedure from this point on is the same as in Example 1. The product resulting is an excellent concentrated heavy duty non-phosphate detergent-softener, useful for washing of laundry at a concentration of 0.1 to 0.2% in the wash water (0.15% is most frequently employed in top-loading washing machines). The product is of a bulk density of about 0.7 to 0.8 g./cc. and is free flowing after normal storage without the use of a barrier carton. The hydrous silicate content helps to increase the building effects of the detergent and improves anti-corrosion activity thereof too, compared to the products of Example 1, although those products are also satisfactory in both such respects.

EXAMPLE 3

| | Percent |
|---|---|
| Snowlite I | 27 |
| Neodol 25-7 | 19 |
| Neodol 25-3S (sodium polyethoxy higher fatty alcohol sulfate [$C_{12-15}$ alcohol and 3 mols of ethylene oxide per mol], 60% active ingredient, 25% $H_2O$ and 15% $C_2H_5OH$, mfd. by Shell Cemical Company) | 4 |
| Type 4A zeolite (Zeolite CH-252-91-1) | 40 |
| Distearyl dimethyl ammonium chloride | 10 |

The manufacturing procedure of Example 1 is are followed, where applicable, with the exception that Neodol 25-3S is mixed with the Neodol 25-7 and both are sprayed onto the Snowlite particles together. The product resulting is an excellent heavy duty detergent-softener, free flowing, non-tacky, non-lumping on storage and of desirable high bulk density (0.6 to 0.8 g./cc.). Due to the content of the additional anionic detergent this product is a slightly better washing agent than that of Example 1. No objectionable interference of the anionic and cationic materials present results on storage because of the segregation of the two types of materials and the particles. In a modification of the procedure of the example the cationic softener is added to the base particles with nonionic detergent and the anionic detergent is mixed with the zeolite and is added to the essentially nonionic-coated particles. In another modification, the Neodol 25-3S, with some of the Neodol 25-7, is first added to the carbonate-bicarbonate particles and additional nonionic detergent is then added as a coating for such particles, to insulate the anionic detergent from the post-added quaternary ammonium compound. In still another modification of the experiment 0.5% of Tinopal ® 5BM fluorescent brightener replaces a similar percentage of Neodol 25-3S and is mixed with the Snowlite before application of the Neodol 25-7 and Neodol 25-3S thereto. Thus, it is insulated from the post-applied quaternary compound. All such products are of the desirable particle sizes, bulk densities and other product characteristics previously reported.

EXAMPLE 4

This example describes a further modification in the products and methods of this invention, wherein additional quantities of nonionic detergent are capable of being incorporated in the product by utilization of sequential coating techniques. In Examples 1–3 above, the liquid nonionic detergent is applied in sufficient quantity so that it penetrates into the interiors of the Snowlite or other base particles, with such an excess present that it wets the surfaces of the particles so as to cause the zeolite powder to adhere to such surfaces. In some cases, when it is desired to employ more nonionic detergent in the product, making a more concentrated detergent composition, and the procedures of Examples 1-3 are followed, the excess liquid causes or promotes the production of an agglomerate or paste. By the method of this example such undesirable result is avoided and additional nonionic detergent is satisfactorily incorporated in the product, which is still free flowing and of high bulk density. Also, by this method the particle size may be increased desirably.

The procedures of Examples 1-3 are followed but in each case, based on 100 parts of product resulting from the practice of the methods of those examples, an additional five parts of the nonionic detergent are sprayed onto the product and an additional ten parts of zeolite are then mixed in with the product to be adhered to the nonionic coating thereon (using the spraying and mixing procedures described in Examples 1-3). The particle size increases about 5% (diameter) but the product is still of about the same bulk density as was previously obtained and still is free flowing and non-lumping. In further experiments, an additional five parts of the nonionic detergent are sprayed onto the two-stage product and an additional ten parts of the zeolite are dusted onto this, with similar desirable results (using the same spraying and mixing methods).

In the practice of the sequential enrichment and coating operations described, the Snowlite or other base particle and the quaternary ammonium softening compound will usually not be re-applied but this may be done when advantageous. Normally as many as six coating operations may be employed but it is preferred that this be limited to three such operations, as in the "further experiment" described herein. Also, it is preferred that the totals of nonionic detergent and zeolite in coating operations subsequent to the first operation should be limited to the amounts employed in the first operation and preferably to halves of such amounts, with proportions of the nonionic and zeolite being within the proportions of the previously mentioned percentage ranges.

EXAMPLE 5

The procedures of Examples 1–4 are repeated, with Snowlite II being substituted for Snowlite I, types X and Y crystalline zeolites of similar particle sizes and amorphous zeolites being substituted for the type 4A zeolite and Neodols 23–6.5 and 45–11 and Alfonics 1618–65 and 1412–60 being substituted for the Neodol 25–7 and Aliquats H226 and 400, Arquad 2HT-100 Culversoft WS paste and Varisoft 100 replacing the Arosurf TA-100, and comparable high bulk density, free flowing detergent-softener compositions are made. The only changes in manufacturing techniques are in maintaining the temperature of the nonionic detergent sufficiently high to ensure that it is in the liquid state when it is sprayed onto the surfaces of the base particles. Additionally, proportions of the various components are modified ±10% and ±30%, while being kept within the ranges of percentages and proportions previously mentioned. Care is taken that the proportion of nonionic detergent employed is such as to provide an unabsorbed portion on the surface of the base beads in the form of an adhering coating so as to hold the zeolite particles. When the nonionic detergent is normally solid the temperature of the detergent at the time of application of the zeolite is maintained high enough so that the zeolite particles will adhere to it and the base particles. Also, when the cationic softening agent is a solid and is to be applied internally of the base particles the temperature thereof will be raised high enough as to liquefy it for such application, whether alone or with nonionic detergent.

The especially desirable results obtained in the above examples and in following the procedures of this invention to make the compositions thereof are unexpected. Although the employment of mixed sodium carbonate-bicarbonate products (each particle includes such a mixture) of the type described in U.S. Pat. No. 3,944,500 as absorbents for nonionic detergents had been suggested, there was no teaching that high bulk density products like those of this invention could be made using such nucleus particles. In fact, the Wegscheider's salt carbonat-bicarbonate materials, which often also include sesquicarbonate, are described as being of low bulk density (the range is about 0.4 to 0.5 g./cc.). In the present cases, although 0.6 g./cc. is considered to be a high bulk density (tamped) for detergent-softener products, usually the products made in accord with this invention will have even higher densities, normally being about 0.7 g./cc. or higher. The presence of the zeolite particles and their being held to the base particles is not described in the prior art nor is the concept of utilizing sufficient liquid nonionic detergent to maintain a coating thereof on the base particles, despite the high sorption of liquid by such particles. Nor is the incorporation of a cationic softening agent in such compositions in the various ways described and the protection of it from reactive materials in the composition and from initial contact with laundry being washed. By the method of this invention one makes a non-segregating, free-flowing product of desirable comparatively large particle size containing even more nonionic detergent than the base particles can normally hold. During the application of the nonionic detergent to the nucleus particles, which absorb much of the nonionic, the "excess" nonionic forms a coating on the surfaces of the particles which is of a greasy or waxy appearance and the particles do not agglomerate objectionably but do hold the smaller zeolite particles subsequently applied. The mix before addition of the zeolite is not pasty; rather, it resembles moist sand, with each particle unattached to other such particles or releasably attached. The final products made are free flowing despite the presence of 10 to 100% of the Wegscheider's salt needles in the base materials, partly because the coating of more finely divided zeolite helps to round them or make the particles spherical. Additionally, the relative locations of the various components in the product beads are desirable functionally and the buffering action of the base particles, when carbonate-bicarbonate is used, is helpful in washing (the pH of a 0.1% aqueous solution of the Snowlites is about 9.8).

It is considered to be important that the finished product particles are in the range of comparatively large sizes given but when, in the above examples, conditions are changed (usually by using smaller base particles) so that smaller particles result, e.g., those in the 8 to 100 mesh range, higher bulk densities than those of usual detergent-softeners are obtained and the products made are useful in various detergent-softener applications although they are not as free flowing or attractive as the preferred embodiments of this invention.

The invention has been described with respect to working examples and illustrations thereof but is not to be limited to these because it is evident that one of skill in the art with access to the present specification will be able to employ substitutes and equivalents without departing from the spirit or scope of the invention.

What is claimed is:

1. A free flowing particulate detergent-softener composition of bulk density of at least 0.6 g./cc. and particle sizes in the range of 4 to 40 mesh which comprises about 20 to 40% by weight of nucleus particles of an alkali metal builder salt selected from the group consisting of sodium carbonate mixed with sodium bicarbonate, sodium carbonate, sodium bicarbonate, pentasodium tripolyphosphate, tetrasodium pyrophosphate, sodium silicate, borax, corresponding potassium salts, and mixtures thereof, and said nucleus particles having internal passageways capable of absorbing 10 to 30% by weight of liquids; about 12 to 30% by weight of a normally liquid or pasty nonionic detergent selected from the group consisting of fatty alcohol polyethylene oxide condensates wherein the fatty alcohol is of about 10 to about 18 carbon atoms and the polyethylene oxide is of about 3 to about 15 moles of ethylene oxide per mole of higher fatty alcohol; about 30 to 60% by weight of exchanging zeolite aluminosilicate particles selected from a crystalline zeolite, amorphous zeolite, or a mixture of crystalline and amorphous zeolite, wherein the exchange rate and capacity of said zeolite are such that when about 375 ppm of said zeolite on an anhydrous basis is placed in water at 45° C. containing about 40 ppm dissolved calcium ion while vigorously stirring, the dissolved calcium ion content of the water is reduced to below about 8 ppm in about 5 minutes, and said zeolite particles having ultimate particle diameters in the range of from about 0.01 to about 20 microns; and about 4 to 12% by weight of a waxy quaternary ammonium compound softening agent, selected from the group consisting of soluble salts of quaternary ammonium compounds containing one or two long chain hydrophobic groups and two or three short chain groups; wherein, a portion of said nonionic detergent is present in the interior of said nucleus particles, said agent is present within and/or external to said nucleus particles, and said zeolite particles and the remaining portion of said nonionic detergent are present as at least two coats on said nucleus particles, a coat being zeolite particles adhered to nonionic detergent, and the amounts of said nonionic detergent and zeolite particles which have been applied as recoatings being from about 5 to about 50% by weight of the total amounts of said nonionic detergent and zeolite particles present in the composition.

2. The detergent-softener according to claim 1 wherein said nucleus particles are comprised of sodium carbonate mixed with sodium bicarbonate in a weight ratio of about 1:10 to 10:1, and the quaternary ammonium compound softener is a normally solid quaternary ammonium halide in particulate form.

3. The detergent-softener according to claim 2 wherein the alkali-metal carbonate is sodium carbonate, the alkali metal bicarbonate is sodium bicarbonate, the mixed sodium carbonate and sodium bicarbonate includes Wegscheider's salt and the weight ratio of sodium carbonate to sodium bicarbonate is about 1:3 to 1:1, said zeolite is a crystalline type A zeolite, of an ultimate particle size in the range of about 3 to about 12 microns, and a moisture content of about 10 to about 25%, and the quaternary ammonium halide is a di-higher alkyl, di-lower alkyl quaternary ammonium chloride; said detergent-softener being comprised of substantially spherical particles.

4. The detergent-softener according to claim 2 or claim 3 wherein said zeolite is adhered to said nonionic detergent on the surface of said nucleus particles, and said quaternary ammonium softening agent is located on the surface of said zeolite-coated particles.

5. The detergent-softener according to claim 2 wherein said zeolite is a type 4A crystalline zeolite and said quaternary ammonium compound is distearyl dimethyl ammonium chloride.

6. The detergent-softener according to claim 2 wherein the softening agent is within the nucleus particles.

7. A method of making a free flowing, particulate detergent softener composition according to claim 1, which comprises:

mixing together said nucleus particles and liquid forms of said agent and a first amount of said nonionic detergent so that said agent and detergent are absorbed in and externally cover said nucleus particles producing covered nucleus particles, admixing with said covered nucleus particles a first amount of zeolite particles which adhere to said agent and detergent covering said covered particles and produce zeolite and detergent coated particles, and admixing with said zeolite and detergent coated particles, in sequence, at least another amount of said nonionic detergent and at least another amount of said zeolite to produce recoated particles, wherein the additional amounts of said nonionic detergent and zeolite being applied as recoatings subsequent to application of said first amount of detergent and said first amount of zeolite particles are from about 5 to about 50% by weight of the total amounts of said nonionic detergent and zeolite particles used.

8. A method according to claim 7 wherein the nucleus particles of alkali metal carbonate and alkali metal bicarbonate, include Wegscheider's salt, the quaternary ammonium compound softening agent is di-higher alkyl, di-lower alkyl quaternary ammonium chloride, and the nonionic detergent and quaternary ammonium chloride are sprayed onto moving surfaces of the nucleus particles, the proportion of sodium carbonate to sodium bicarbonate is within the range of 1:3 to 1:1, the particle sizes of the mixed sodium carbonate and sodium bicarbonate nucleus particles are in the 20 to 100 mesh range and the particle sizes of the final products are in the 4 to 40 mesh range.

9. A method according to claim 8 wherein the product of the method of claim 8 is further coated with a nonionic detergent in the liquid state, which detergent is a normally liquid or pasty higher fatty alcohol-polyethylene oxide condensate wherein the higher fatty alcohol is of about 10 to 18 carbon atoms and the polyethylene oxide is of about 3 moles to about 15 moles of ethylene oxide per mole of higher fatty alcohol, and such detergent is coated with a zeolite which is selected from the group consisting of crystalline, amorphous or mixed crystalline and amorphous zeolites wherein said crystalline zeolite is selected from the group consisting of A, X and Y crystalline zeolites, and the amounts of such nonionic detergent and zeolite post-applied to the product of the method of claim 8 are no more than halves of the total contents of such nonionic detergent and zeolite in said product as stated in the process of claim 8.

* * * * *

UNITED STATES PATENT AND TRADEMARK OFFICE

CERTIFICATE OF CORRECTION

PATENT NO. : 4,339,335

DATED : July 13, 1982

INVENTOR(S) : Harold E. Wixon

It is certified that error appears in the above—identified patent and that said Letters Patent is hereby corrected as shown below:

Col. 4, line 48, change "to" to --or--.

Col. 7, lines 21 and 22, after all numbers insert " / 73".

Col. 8, line 51, change "copmonent" to --component--.

Col. 9, line 32, change "produce" to --product--.

Col. 12, line 35, change "zolite" to --zeolite--.

Col. 14, line 20, change "develope" to --develop--.

Col. 14, lines 62-63, change "contaiing" to --containing--.

Col. 16, line 30, change "cemical" to --chemical--.

Signed and Sealed this

Ninth Day of November 1982

[SEAL]

*Attest:*

GERALD J. MOSSINGHOFF

*Attesting Officer*

*Commissioner of Patents and Trademarks*